US005355055A

United States Patent [19]

Tary

[11] Patent Number: 5,355,055

[45] Date of Patent: Oct. 11, 1994

[54] LIGHTING ASSEMBLY AND AN ELECTRONIC BALLAST THEREFOR

[75] Inventor: Tamas Tary, Mission, Canada

[73] Assignee: Ganaat Technical Developments Ltd., Port Moody, Canada

[21] Appl. No.: 933,201

[22] Filed: Aug. 21, 1992

[51] Int. Cl.[5] ..... H05B 37/00

[52] U.S. Cl. ..... 315/209 R; 315/307; 315/219; 315/DIG. 4; 315/DIG. 7; 362/265; 362/261; 362/70

[58] Field of Search ..... 315/209 R, 307, 219, 315/DIG. 4, DIG. 7; 362/265, 261, 70, 71, 72

[56] References Cited

U.S. PATENT DOCUMENTS

| | | | |
|---|---|---|---|
| 4,127,798 | 11/1978 | Anderson | 315/209 R |
| 4,463,286 | 7/1984 | Justice | 315/219 |
| 4,469,988 | 9/1984 | Cronin | 315/209 |
| 4,749,914 | 6/1988 | Fehér et al. | 315/209 R X |
| 4,870,327 | 9/1989 | Jorgensen | 315/307 |
| 4,983,887 | 1/1991 | Nilssen | 315/224 |
| 5,039,919 | 8/1991 | Nilssen | 315/209 |
| 5,099,176 | 3/1992 | Fellows et al. | 315/209 R X |
| 5,103,138 | 4/1992 | Orenstein et al. | 315/209 R |
| 5,128,593 | 7/1992 | Gilbert | 315/209 R X |

*Primary Examiner*—Robert J. Pascal
*Assistant Examiner*—Reginald A. Ratliff
*Attorney, Agent, or Firm*—John R. Uren

[57] ABSTRACT

An electronic ballast for discharge lamps comprises an open loop configuration of an impedance converter first stage and an inverter second stage linked by a limiting control stage. The impedance converter stage presents its load, passive or active, as input resistance. It draws a continuous current, through large RFI/EMI suppressing input inductors, which is switched discontinuously through a tank circuit using an energy transfer relationship based on the switch on-time and the inductance and capacitance of the tank circuit. The impedance converter stage supplies unregulated power to the inverter stage which operates stably at a fixed frequency. If an imbalance such as an overcurrent condition or an overvoltage condition develops in the system, the limiting control stage temporarily preempts the converter switching until stability is reestablished.

16 Claims, 8 Drawing Sheets

| LABEL | TYPE OR VALUE |
|---|---|
| C28 | 0.01uF, 1KV (CHOSEN TO REDUCE LINE RIPPLE) |
| C29 | 0.1 uF, 250 V |
| C30 | 0.1uF, 250V |
| C31 | 1500uF, 35V (ELECTROLYTIC) |
| C32 | 1uF, 63V (STACKED COIL) |
| C33 | 2.2uF, 63V (STACKED COIL) |
| C34 | 0.1uF, 50V (CERAMIC) |
| C35 | 0.1uF, 50V (CERAMIC) |
| C36 | 0.1uF, 100V (STACKED COIL) |
| C37 | 0.0033uF, 630V (POLYPROPYLENE) |
| C38 | 22uF, 16V (ELECTROLYTIC) |
| C39 | 100pF, 100V (CERAMIC) |
| C40 | 4.7uF, 16V (ELECTROLYTIC) |
| C41 | 100pF, 100V (CERAMIC) |
| DB3 | 1N4005 (x4) |
| D23 | 1N4936 |
| D24 | 1N4148 |
| D25 | 1N4148 |
| D26 | 1N4936 |
| D27 | 1N4936 |
| D28 | 1N4148 |
| D29 | 1N4148 |
| D30 | 1N4936 |
| D31 | 1N4936 |
| D32 | 1N4148 |
| D33 | 1N4148 |

FIG. 10 (1/2)

| | |
|---|---|
| D34 | IN4148 |
| IC1 | TLC555 |
| L5 | 0.04H, 0.5A |
| L6 | 200uH, 6A |
| Q7 | IRF 830 |
| Q8 | 2N4401 |
| Q9 | 2N4403 |
| Q10 | 2N4401 |
| Q11 | 2N4403 |
| R7 | 1 ohm, 1/2W |
| R8 | 430K, 1/4W |
| R9 | 430K, 1/4W |
| R10 | 22K, 1W |
| R11 | 91K, 1/4W |
| R12 | 620K, 1/4W |
| R13 | 680 ohm, 1/4W |
| R14 | 3.3K, 1/4W |
| R15 | 750 ohm, 1/4W |
| R16 | 56 ohm, 1/4W |
| R17 | 10K, 1/4W |
| R18 | 5.1K, 1/4W |
| T6 | CURRENT TRANSFORMER<br>T6a:T6b = 1:10 |
| T7 | OUTPUT LEAKAGE TRANSFORMER<br>LEAKAGE INDUCTANCE = 650uH a T7d<br>T7a:T7b:T7c:T7d = 18:6:6:6:77 |
| Z1 | IN5243B, 13V |
| Z2 | IN5243B, 13V |

FIG. 10 (2/2)

LIGHTING ASSEMBLY AND AN ELECTRONIC BALLAST THEREFOR

INTRODUCTION

This invention relates to electronic ballasting for discharge lamps, and more particularly, to electronic ballasting for low pressure gas discharge fluorescent lamps and high intensity arc discharge lamps.

BACKGROUND OF THE INVENTION

Ballasting circuitry for discharge lamps is known in the prior art. A basic lamp ballasting circuit has several functions:

1. To preheat the lamp electrodes so that they will emit electrons.
2. To provide sufficient open circuit voltage to initiate an arc.
3. To limit the current flowing through the negative resistance arc.
4. To reinitiate the arc on each half cycle of the applied AC voltage.
5. To regulate the lamp current against line voltage changes.
6. To minimize power loss.
7. To provide a high power factor.

These competing design goals have encouraged the design of a large number of lamp ballasting circuits. The conventional solution was to use large reactors to limit arc current without incurring resistive losses, to provide regulation, and to produce high voltages for igniting the arc. However, the conventional circuits suffered from high losses in the inductor cores.

Developments in power electronics have encouraged design efforts to further reduce losses and to extend lamp life by improving power conditioning. The electronic ballast further design goals include:

1. To provide low harmonics to the lamp in order to extend lamp life.
2. To reflect low harmonics to the power line.
3. To reflect a low ripple to the power line.
4. To operate the lamp at a frequency significantly higher than the power line frequency in order to reduce lamp flickering and to increase luminous efficacy.
5. To reduce electromagnetic interference (EMI) and radio frequency interference (RFI).

The prior art includes many different electronic ballasting circuits. The conventional electronic ballast comprises an AC to DC rectification first stage followed by a DC to AC inversion second stage. Early examples of this circuit are U.S. Pat. No. 4,463,286 (Justice) and U.S. Pat. No. 4,469,988 (Cronin). The '286 and '988 patents teach simple open-loop circuits that provide high frequency sinusoidal signals to pre-heat, start and run discharge lights.

However, the simpler conventional electronic ballasts such as the '286 and '988 patents have limitations. One limitation is the poor regulation these circuits provide. Because of the open-loop nature of the circuits, lamp intensity varies with fluctuations in the power line. Further, there can be difficulties in maintaining the stability of the inverter oscillations under certain conditions such as lamp burnout. Instability in a circuit that switches power signals can also be a significant problem.

Attempts have been made to overcome these limitations of the conventional electronic ballast. U.S. Pat. Nos. 4,983,887 and 5,039,919 (both continuations-in-part of U.S. Pat. No. 4,819,146) to Nilssen describe an intricate circuit and a complicated feedback control system. The '919 patent teaches a circuit that employs feedback from: a) the magnitude of the inverter's output current, b) the magnitude of the voltage present across the tank-capacitor, c) the magnitude of the current flowing through the lamps, d) the setting of an adjustment means operative to adjust the amount of light output, e) a temperature associated with the inverter, and f) the magnitude of any ground-fault current that might be flowing.

The circuit of the '887 patent is intricate and still suffers from essentially the same problems as the prior conventional electronic ballasts. The difficulty in regulating and stabilizing the inverter stage of the conventional circuit means that the circuit parameters have to be continuously adjusted with the effect that the circuit does not run cleanly or efficiently. With the large number of discharge lamps in existence, it is desirable that electronic ballast perform efficiently and interfere minimally with the surrounding electrical environment, including power lines.

An improved electronic ballast is taught in U.S. Pat. No. 4,870,327 (Jorgensen). The '327 patent teaches a structure for an electronic ballast which comprises an AC to DC rectification first stage followed by a DC to DC conversion second stage followed by a DC to AC inversion third stage and a control stage for both the converter and inverter which accepts feedback from both the converter and inverter.

The circuit of the '327 patent also has drawbacks. The main drawback arises from the complexity of the control and feedback circuitry. It uses either one or two pulse width modulation integrated circuits to analyze the inverter input voltage, the inverter input current and the converter peak current to continuously set the pulse width of the converter and the frequency of the inverter.

SUMMARY OF THE INVENTION

According to one aspect of the invention, there is provided an electronic ballast comprising a) means for converting a general impedance load into a resistance, said converting means comprising i) means for receiving electrical energy and maintaining a continuous direct current, ii) means for storing electrical energy connected serially to said receiving and maintaining means, and iii) means for periodically discharging said energy storing means as a discontinuous direct current supplied to the load; and b) means for inverting said discontinuous direct current into an alternating current connected serially as a load to said converting means for receiving said discontinuous direct current, said inverting means comprising i) means for receiving said discontinuous direct current to be inverted, ii) means for receiving the inverted alternating current, iii) means for connecting said direct current receiving means to the alternating current receiving means for the purpose of supplying the discontinuous direct current to the alternating current receiving means and for periodically reversing the polarity of the connection so as to supply the negative discontinuous direct current to the alternating current receiving means whereby an alternating current with a frequency equal to the polarity reversal frequency is supplied to the alternating current receiving means, iv) means for supplying the alternating current and for applying an alternating potential difference connected to the alternating current receiving means, and v) means responsive to the magnitude of the alternating potential difference operable to change the polarity reversal frequency.

According to a further aspect of the invention, there is provided an electrical circuit for converting a general impedance load into a resistance comprising a) means for receiving electrical energy and for maintaining a continuous direct current, b) means for storing electrical energy connected serially to said receiving and maintaining means whereby said electrical energy received is stored as a continuous direct current, and means for periodically discharging said storing means as a discontinuous direct current supplied to the load.

According to yet a further aspect of the invention, there is provided an electrical circuit for inverting a direct current into an alternating current comprising i) means for receiving the direct current to be inverted, ii) means for receiving the inverted alternating current, iii) means for connecting the direct current receiving means to the alternating current receiving means for the purpose of supplying the direct current to the alternating current receiving means and for periodically reversing the polarity of the connection for the purpose of supplying the negative direct current to the alternating current receiving means whereby an alternating current with a frequency equal to the polarity reversal frequency is supplied to the alternating current receiving means; iv) means for supplying the alternating current and for applying an alternating potential difference connected to the alternating current receiving means; and v) means responsive to the magnitude of the alternating potential difference applied operable to change the polarity reversal frequency.

According to yet a further aspect of the invention, there is provided a lighting assembly comprising a) a lamp; b) a reflector surrounding at least a portion of said lamp; c) a shell encircling at least a portion of the periphery of said lamp and reflector; d) a connection operable to be mounted within a receptacle of a lighting fixture; and e) a ballast mounted between the inside of said shell and the outside of said reflector.

BRIEF DESCRIPTION OF THE SEVERAL VIEWS OF THE DRAWINGS

Specific embodiments of the invention will now be described, by way of example only, with reference to the accompanying drawings in which:

FIGS. 10 (1 and 2) is a parts list for the electronic ballast according to the invention.

DESCRIPTION OF THE SPECIFIC EMBODIMENT

Figure 1:
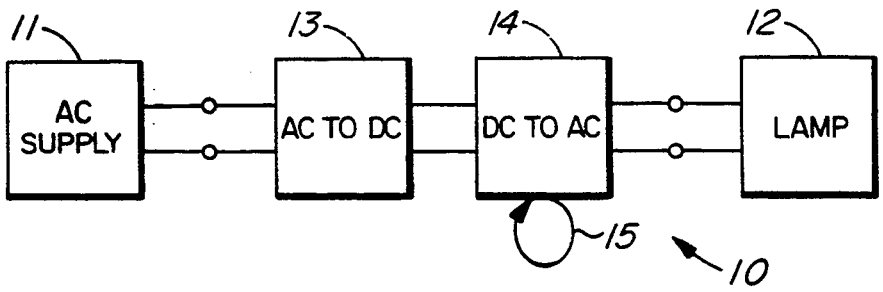
FIG. 1 PRIOR ART
FIG. 1 is a block diagram of a conventional electronic ballast.

With reference now to the drawings, a conventional electronic ballast is generally illustrated at 10 in FIG. 1. The ballast 10 is placed between an AC power supply 11 and a discharge lamp 12. The ballast 10 comprises an AC to DC rectification first stage 13 followed by a DC to AC inversion second stage 14. A plurality of feedback loops 15 are provided within the inversion stage 14.

Figure 2:
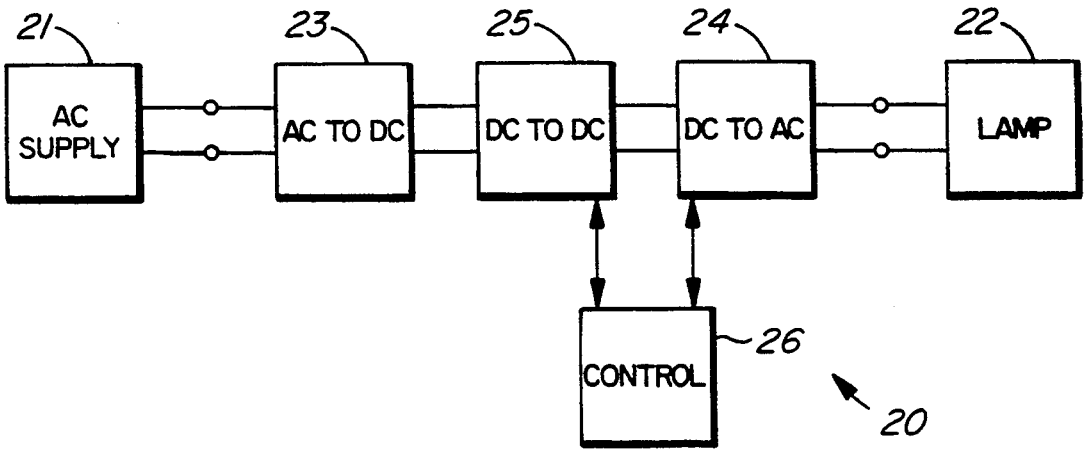
FIG. 2 PRIOR ART
FIG. 2 is a block diagram of a further conventional electronic ballast.

An electronic ballast as taught in the aforementioned U.S. Pat. No. 4,983,887 is generally illustrated at 20 in FIG. 2 between an AC power supply 21 and a discharge lamp 22. As well as including an AC to DC rectification first stage 23 and a DC to AC inversion third stage 24, the electronic ballast 20 includes an intermediate DC to DC conversion second stage 25 and a control stage 26 which continuously senses and tunes the inverter stage 24 and the converter stage 25.

Figure 3:
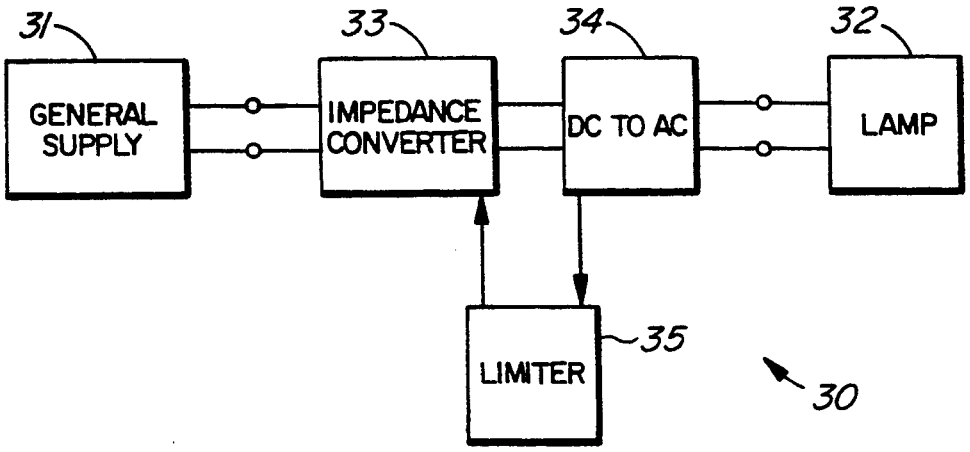
FIG. 3 is a block diagram of the electronic ballast according to the present invention.

The electronic ballast according to the present invention is generally illustrated at 30 in FIG. 3 between a general power supply 31, ranging from DC to about 400 Hz, and a discharge lamp 32. The ballast 30 is comprised of an impedance converter first stage 33, a DC to AC inverter second stage 34 and a limiting control stage 35 which restricts the operation of the impedance converter 33 according to the operation of the inverter 34.

Figure 4:
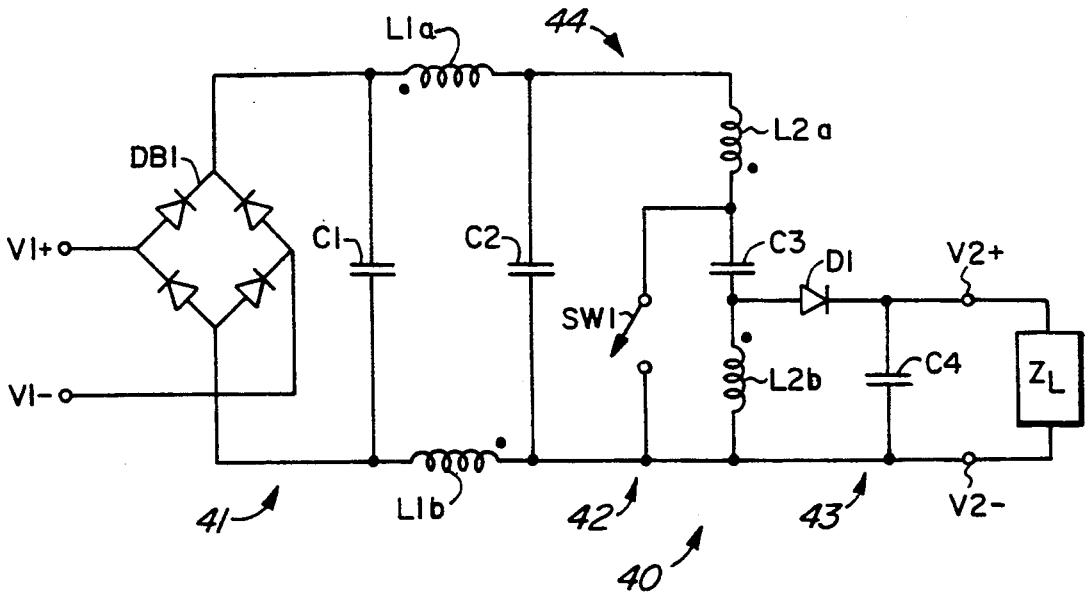
FIG. 4 is a schematic of the impedance converter stage according to the invention.
Figure 5:
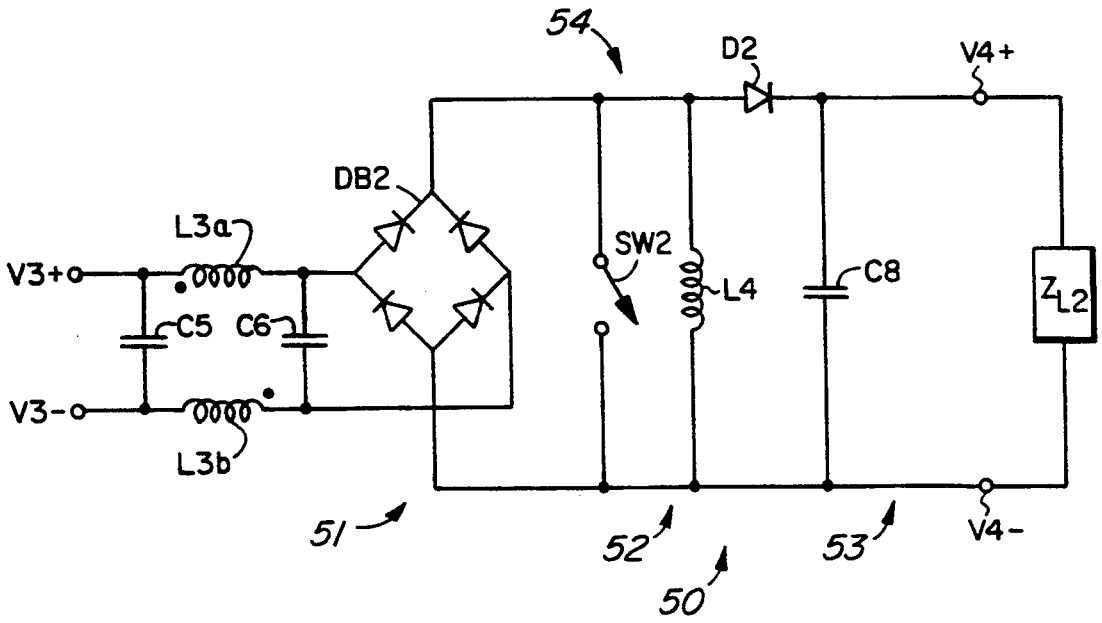
FIG. 5 is a schematic of an alternative embodiment of the impedance converter stage of FIG. 5.

FIGS. 4 and 5 illustrate two embodiments of the circuitry of the impedance converter first stage 33. With reference first to FIG. 4, an impedance converter is generally illustrated at 40. The converter 40 comprises an input stage generally illustrated at 41, an impedance conversion stage generally illustrated at 42, and an output stage generally illustrated at 43.

The input stage 41 comprises two input nodes V1+ and V1−, a diode bridge DB1 connected at its input to the input nodes V1+ and V1−, a filter capacitor C1 placed across the output terminals of the diode bridge DB1 and two large magnetically coupled EMI/RFI suppressing input inductors **L1*a* and L1*b* connected to the output terminals of diode bridge DB1**.

The impedance conversion stage 42 comprises a tank circuit generally illustrated at 44 connected at either end to the output of inductor **L1*a* or L1*b*, and a switch SW1 dividing the tank circuit 44. The tank circuit 44 comprises two capacitors C2 and C3 coupled to be effectively in parallel through two magnetically coupled inductors L2*a* and L2*b***.

The output stage 43 comprises an output rectifier diode D1, an output node V2+ connected to the tank circuit 44 through output rectifier diode D1, an output node V2− connected directly to the output terminal of inductor **L1*b*, and a filter capacitor C4 between the nodes V2+ and V2−. In operation, a general impedance ZL1 is connected between the output nodes V2+ and V2−**.

With reference now to FIG. 5, an impedance converter is generally illustrated at 50. The converter 50 comprises an input stage generally illustrated at 51, an impedance conversion stage generally illustrated at 52, and an output stage generally illustrated at 53.

The input stage 51 comprises two input nodes V3+ and V3−, two large magnetically coupled EMI/RFI suppressing input inductors L3*a* and L3*b* extending from the input nodes V3+ and V3−, a filter capacitor C5 connecting the input terminals of the inductors L3*a* and L3*b*, a filter capacitor C6 connecting the output terminals of inductors L3*a* and L3*b*, and a diode bridge DB2 extending from the output terminals of inductors L3*a* and L3*b*.

The impedance conversion stage 52 comprises a tank circuit generally illustrated at 54 connected at either end to the positive or negative output terminal of diode bridge DB2 and a switch SW2 shortcircuiting the two ends of the tank circuit 54. The tank circuit 54 comprises a capacitor C7 and an inductor L4.

The output stage 53 comprises an output rectifier diode D2, an output node V4+ connected to the tank circuit 54 through output rectifier diode D2, an output node V4− connected directly to the negative output terminal of the diode bridge DB2 and a filter capacitor C8 connected between the output nodes V4+ and V4−. In operation, a general impedance ZL2 is connected between the output nodes V4+ and V4−.

Figure 6:
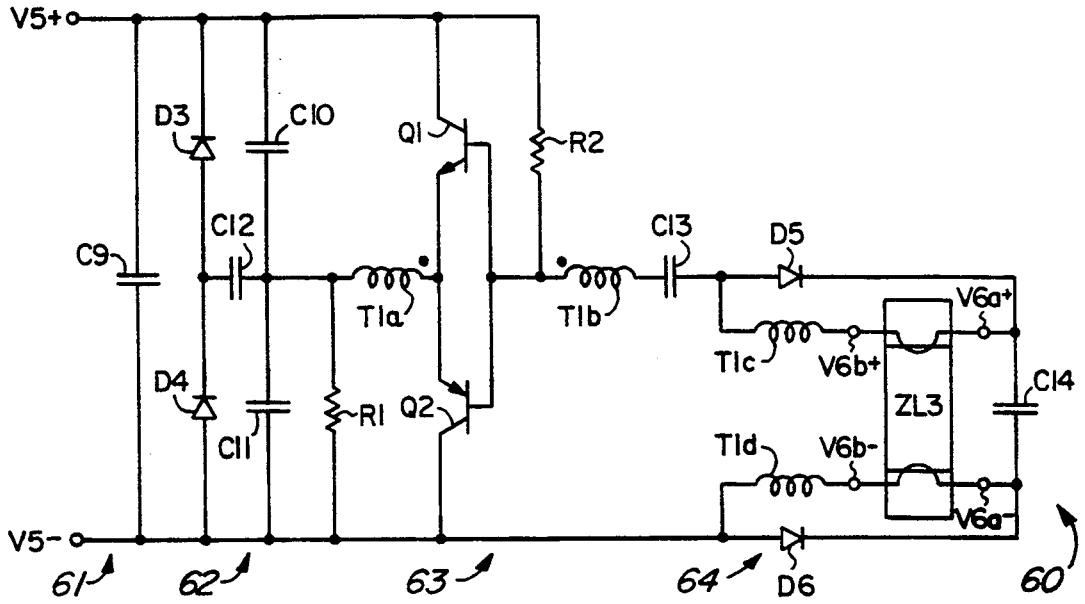
FIG. 6 is a schematic of the inverter stage according to the invention.
Figure 7:
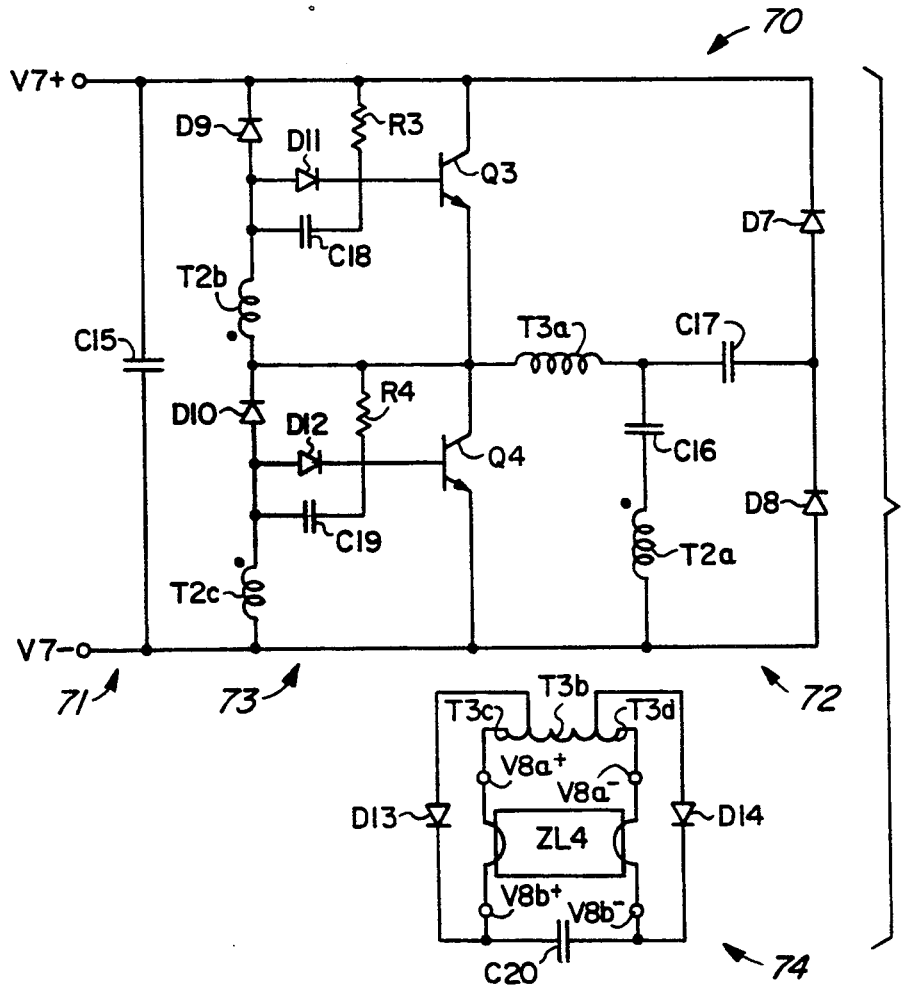
FIG. 7 is a schematic of an alternative embodiment of the inverter stage of FIG. 6.
Figure 8:
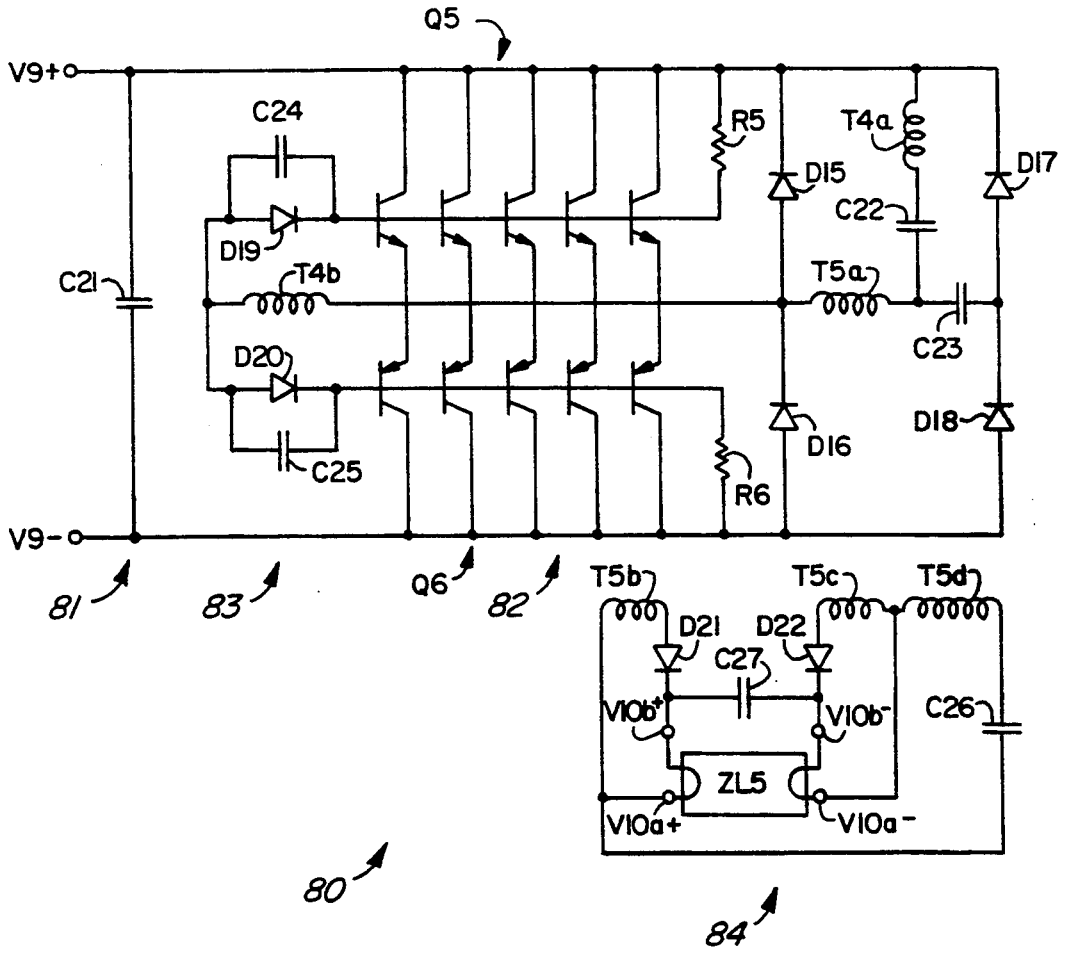
FIG. 8 is a schematic of a further alternative embodiment of the inverter stage of FIG. 6.

FIGS. 6, 7 and 8 illustrate three embodiments of the inverter bridge 34 circuitry. With reference first to FIG. 6, a low voltage, high frequency DC to AC inverter is generally illustrated at 60. The inverter 60 comprises an input stage generally illustrated at 61, an inverter bridge stage generally illustrated at 62, a transistor drive stage generally illustrated at 63 and an output stage generally illustrated at 64.

The input stage 61 comprises two input nodes V5+ and V5−, and a filter capacitor C9 between the nodes V5+ and V5−.

The inverter bridge stage 62 comprises two transistors Q1 and Q2, two capacitors C10 and C11 and two diodes D3 and D4 connected symmetrically between the nodes V5+ and V5− in conventional push-pull inverter bridge topology except that a parasitic capacitor C12 connects the C10/C11 node with the D3/D4 node.

The transistor drive stage 63 comprises two very low level biasing resistors R1 and R2 and a leakage transformer T1 with four windings T1*a*, T1*b*, T1*c* and T1*d*. Windings T1*a* and T1*b* are connected so that the bridge output supplied to winding T1*a* is fed back through winding T1*b* as base drive to transistors Q1 and Q2. A capacitor C13 connected to the output of winding T1*b* appears reflected through the transformer T1 in series with the parallel combination of capacitors C10 and C11 and the leakage inductance of transformer T1 to form a tank circuit.

The output stage 64 comprises an output node V6*a*+ connected to winding T1*b* through DC blocking capacitor C13 and a blocking diode D5, an output node V6*a*− connected to the input node V5− through a blocking diode D6, a resonant starting capacitor C14 connected between the nodes V6*a*+ and V6*a*−, and windings T1*c* and T1*d*, terminating respectively in output nodes V6*b*+ and V6*b*−, connected to the anodes of diodes D5 and D6 respectively. In operation, a discharge lamp load ZL3 is connected to output nodes V6 such that one lamp electrode is connected between nodes V6*a*+ and V6*b*+ and the other lamp electrode is connected between nodes V6*a*− and V6*b*−.

With reference to FIG. 7, a high voltage, high frequency DC to AC inverter is generally illustrated at 70. The inverter 70 comprises an input stage generally illustrated at 71, an inverter bridge stage generally illustrated at 72, a transistor drive stage generally illustrated at 73 and an output stage generally illustrated at 74.

The input stage 71 comprises two input nodes V7+ and V7−, and a filter capacitor C15 connected between the two nodes V7+ and V7−.

The inverter bridge stage 72 comprises two transistors Q3 and Q4, a capacitor C16 and two diodes D7 and D8 connected symmetrically between the nodes V7+ and V7− in conventional push-pull inverter bridge topology except that a parasitic capacitor C17 connects capacitor C16 to the D7/D8 node.

The symmetrical transistor drive stage 73 comprises two resistors R3 and R4 and two Baker clamping diodes D9 and D10 to bias the bases of transistors Q3 and Q4, and two rectifying diodes Dll and D12 and two filtering capacitors C18 and C19 respectively in parallel with the diodes Dll and D12 to apply base drive to transistors Q3 and Q4 as fed back from the bridge output by three transformer windings T2*a*, T2*b* and T2*c*.

The output stage 74 comprises a leakage transformer T3 with a primary winding T3*a* spanning the bridge output and three secondary windings T3*b*, T3*c* and T3*d* connected in series such that the free ends of windings T3*c* and T3*d* terminate in two output nodes V8*a*+ and V8*a*− respectively, two output nodes V8*b*+ an V8*b*− connected to opposite ends of winding T3*b* through two blocking diodes D13 and D14 respectively and a resonant starting capacitor C20 connected between the nodes V8*b*+ and V8*b*−. In operation, a discharge lamp load ZL4 is connected to output nodes V8 such that one lamp electrode is connected between nodes V8*a*+ and V8*b*+ and the other lamp electrode is connected between nodes V8*a*− and V8*b*−.

With reference to FIG. 8, a further inverter circuit is generally illustrated at 80. It comprises an input stage generally illustrated at 81, a bridge stage generally illustrated at 82, a transistor drive stage generally illustrated at 83 and an output stage generally illustrated at 84.

The input stage 81 comprises two input nodes V9+ and V9− and a filter capacitor C21 connected between the nodes V9+ and V9−.

The bridge stage 81 comprises a plurality of transistors in parallel generally illustrated at Q5, a plurality of transistors in parallel generally illustrated at Q6, two diodes D15 and D16, and one capacitor C22 connected symmetrically between nodes V9+ and V9− in conventional push-pull inverter bridge topology except that two optimizing diodes D17 and D18 also span the bridge between nodes V9+ and V9− and a parasitic capacitor C23 connects the capacitor C22 with the D17/D18 node.

The symmetrical transistor drive stage 83 comprises two biasing resistors R5 and R6, and two rectifying diodes D19 and D20 and two filter capacitors C24 and C25 respectively in parallel with diodes D19 and D20 connected to apply base drive to transistors Q5 and Q6 as fed back from the inverter output by a current transformer T4.

The output stage 84 comprises a leakage transformer T5 with a primary winding T5*a* spanning the output of the inverter bridge 82 and three secondary windings T5*b*, T5*c* and T5*d* arranged such that secondary winding T5*d* applies a discharge potential across two resonant starting capacitors C26 and C27 through two output nodes V10*a*+ and V10*a*−, and secondary windings T5*b* and T5*c* supply an electrode preheating current to two output nodes V10*b*+ and V10*b*− through two diodes D21 and D22. In operation, a discharge lamp load ZL5 is connected to output nodes V10 such that one lamp electrode is connected between nodes V10*a*+ and V10*b*+ and the other lamp electrode is connected between nodes V10*a*− and V10*b*−.

Figure 9:
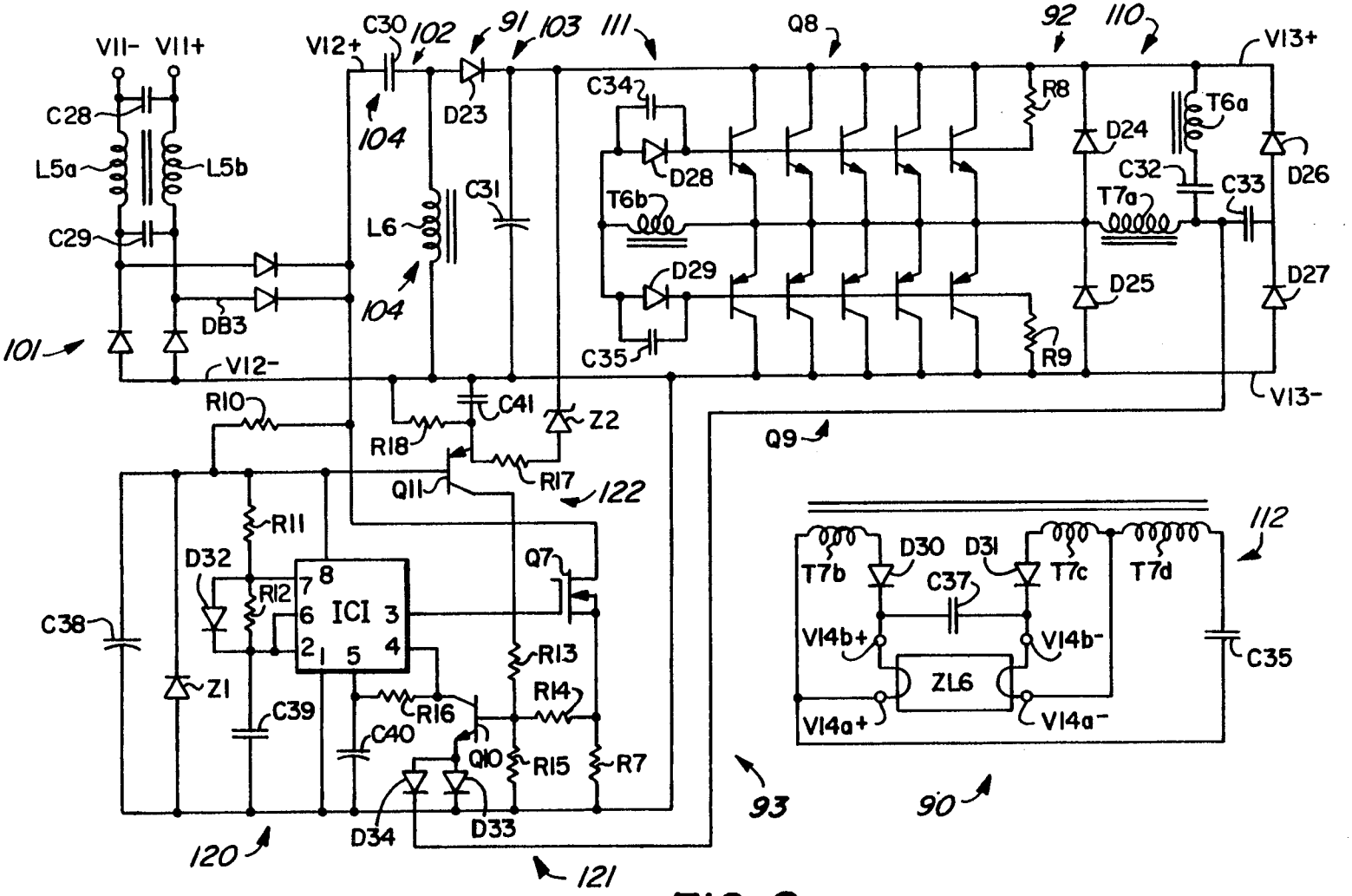
FIG. 9 is a schematic of the electronic ballast according to the invention.

With reference to FIG. 9, the complete electronic ballast 30 is generally illustrated at 90. It comprises an impedance conversion first stage generally illustrated at 91, a DC to AC inversion second stage generally illustrated at 92 and a control stage generally illustrated at 93.

Impedance conversion first stage 91 comprises an input sub-stage 101, a conversion sub-stage 102 and an output sub-stage 103.

Input sub-stage 101 comprises input nodes V11+ and V11−, a large magnetically coupled differential inductor L5*a*/L5*b* emanating from the input nodes V11+ and V11−, a filter capacitor C28 connected between the input terminals of inductors L5*a* and L5*b*, a filter capacitor C29 connected between the input terminals of inductors L5*a* and L5*b* and a diode bridge DB3 connected at its input to differential inductor L5 and at its output to two nodes V12+ and V12−.

Conversion sub-stage 102 comprises a tank circuit generally illustrated at 104 connected between nodes V12+ and V12−, and a mosfet switch Q7 shortcircuiting the two ends of the tank circuit 104 through a resistor R7. The tank circuit 104 comprises a capacitor C30 and an inductor L6.

The output sub-stage 103 comprises a blocking diode D23, an output node V13+ connected to the tank circuit 104 through diode D23, an output node V13− connected directly to node V12− and an output filter capacitor C31 connected between nodes V13+ and V13−.

The inversion stage 92 comprises a bridge sub-stage generally illustrated at 110, a transistor drive sub-stage generally illustrated at 111 and an output sub-stage generally illustrated at 112.

The bridge sub-stage 110 comprises a plurality of transistors in parallel generally illustrated at Q8, a plurality of transistors in parallel generally illustrated at Q9, two diodes D24 and D25, and one capacitor C32 connected symmetrically between nodes V13+ and V13− in conventional push-pull inverter bridge topology except that two optimizing diodes D26 and D27 also span the bridge between nodes V13+ and V13− and a parasitic capacitor C33 connects capacitor C32 with the D26/D27 node.

The symmetrical transistor drive sub-stage 111 comprises two biasing resistors R8 and R9, and two rectifying diodes D28 and D29 and two filter capacitors C34 and C35 respectively in parallel with diodes D28 and D29 connected to apply base drive to transistors Q8 and Q9 as fed back from the inverter output by a current transformer T6.

The output sub-stage 112 comprises a leakage transformer T7 with a primary winding T7*a* spanning the output of the inverter bridge 110 and three secondary windings T7*b*, T7*c* and T7*d* arranged such that secondary winding T7*d* applies a discharge potential across two resonant starting capacitors C36 and C37 through two output nodes V14*a*+ and V14*a*−, and secondary windings T7*b* and T7*c* supply an electrode preheating current to two output nodes V14*b*+ and V14*b*− through two diodes D30 and D31. In operation, a discharge lamp load ZL6 is connected to output nodes V14 such that one lamp electrode is connected between nodes V14*a*+ and V14*b*+ and the other lamp electrode is connected between nodes V14*a*− and V14*b*−.

The control stage 93 comprises a timer sub-stage generally illustrated at 120, an overcurrent detection sub-stage generally illustrated at 121, and an overvoltage detection sub-stage generally illustrated at 122.

The timer sub-stage 120 centers around an industry standard 555 timer IC1, which is configured as is well known in the art using three resistors R10, R11 and R12, three capacitors C38, C39 and C40, a diode D32 and a zener Z1.

The overcurrent detection sub-stage 121 centers around transistor QlO. Transistor Q10 is biased by three resistors R13, R14 and R15. Resistor R13 connects transistor Q10 to the overvoltage detection sub-stage 122. Resistor R14 connects the base of transistor Q10 to the source of mosfet switch Q7 in conversion stage 91. Transistor Q10 connects the reset pin on IC1 to node V12− through a diode D33. The transistor Q10 also connects the filter capacitor C40 to node V12− through a resistor R16 and diode D33. A diode D34 connects the emitter of transistor Q10 to the C32/C33 node in inverter stage 92.

The overvoltage detection sub-stage 122 centres around transistor Q11. The emitter of transistor Q11 is connected to node V12+ through a resistor R17 and a zener Z2 in series and to node V12− by a capacitor C41 and a resistor R18 in parallel. The collector of transistor Q11 connects to overcurrent detection transistor Q10 through resistor R13. The base of transistor Q11 is biased by resistor R10 connected to node V12+. Resistor R10 also supplies power to capacitor C38 and regulator zener Z1.

FIG. 10 is a parts list for the embodiment illustrated in FIG. 9.

Figure 11:
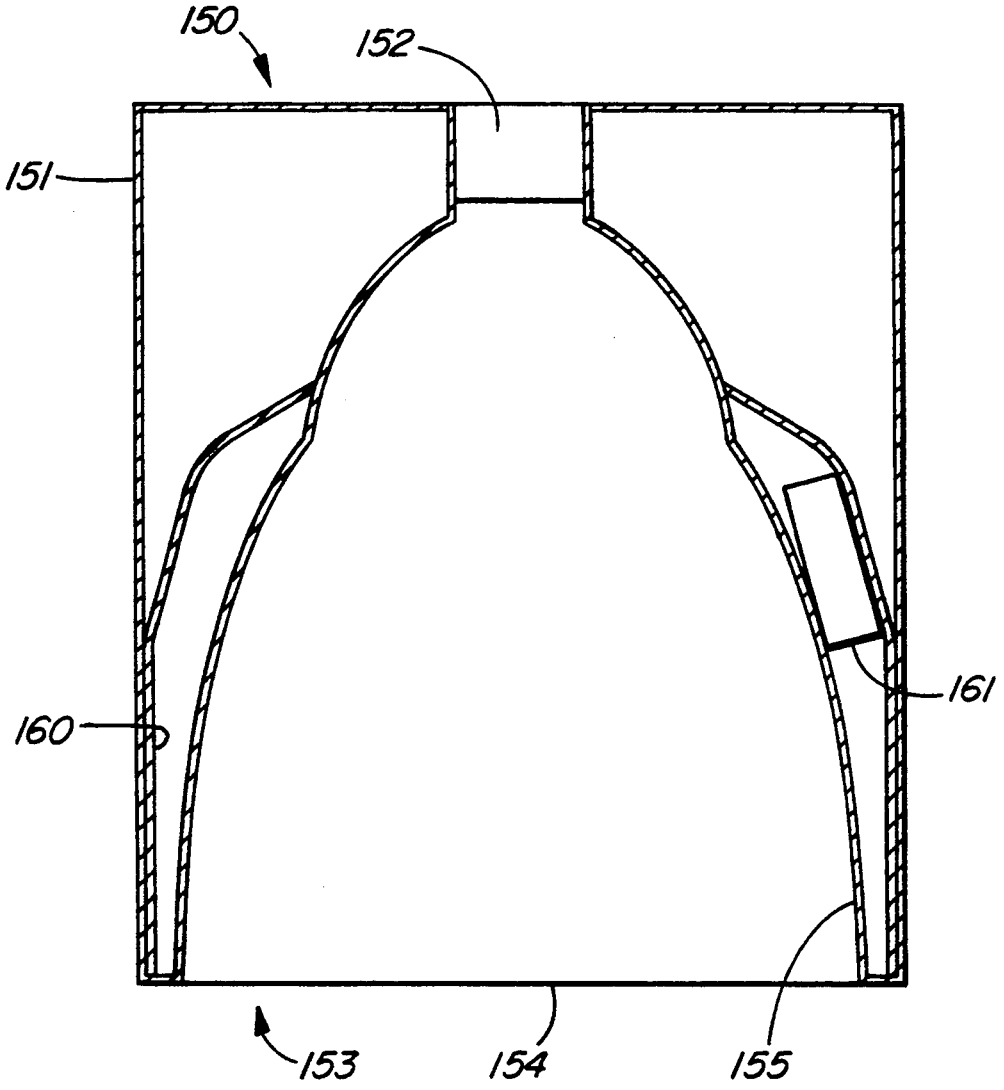
FIG. 11 is a diagrammatic cross-sectional view of an electronic ballast mounted within a recessed can fixture.

With reference to FIG. 11, a recessed-can fixture is illustrated generally at 150 and comprises a cylindrical shell 151 and a socket 152. A lighting unit, generally illustrated at 153, is mounted in fixture 150, either by a threaded assembly which is screwed into socket 152 or directly as by the use of pins (not shown) or the like. The lighting unit 153 comprises a discharge lamp 154 with a reflector 155, a shell 160 partly or fully encircling reflector 155, and a ballast 161 mounted between the lower inside portion of the shell 160 and the lower outside portion of the reflector 155.

OPERATION

The impedance conversion stage 33 presents a high power factor, low harmonic load to the power supply 31, connecting a general impedance, passive or active, to appear as a resistance to the supply 31. The converter draws an input current ranging from DC to about 400 Hz and produces an output current that varies with the square of the input voltage. The operation of converter 33 will be described using two sample circuits, converter 40 and converter 50.

With reference first to FIG. 4, diode bridge DB1 rectifies power received from nodes V1+ and V1− such that the current through the inductors L1 will be direct and there will be no current reversal. Magnetically coupled inductors L1*a* and L1*b* maintain a continuous current, integrating out the input ripple. The self-inductance of each inductor L1*a* and L1*b* acts as a differential mode input filter. Inductors L1*a* and L1*b* are polarized such that together they also act as a common mode input filter. The leakage inductance between inductors L1*a* and L1*b* acts as a differential mode filter.

Capacitor Cl further filters the input signal. This input stage 41 suppresses both EMI and RFI.

Assuming a steady state has been reached, the conversion stage 42 is analyzed just as switch SW1 closes at the beginning of a new cycle. At the moment before switch SW1 closes, capacitors C2 and C3 are charged to an equal voltage and there is no net current through inductors L2*a* and L2*b* because of mutually induced cancellation.

At the instant that switch SW1 closes, capacitor C2 applies its potential across inductor L2*a* and capacitor C3 applies its potential across inductor L2*b*. Diode D1 reverse biases. Capacitors C2 and C3 begin discharging their stored energy into the magnetic fields of inductors L2*a* and L2*b* as though capacitors C2 and C3 and inductors L2*a* and L2*b* are all in parallel. A current builds up in both inductors L2*a* and L2*b*.

When switch SW1 opens, a voltage appears across inductor L2*b*, induced by its collapsing field, that forward biases diode D1 in flyback behaviour. Moreover, the energy in the field of inductor L2*a* is coupled to the field of inductor L2*b* except for that portion necessary to equalize the charge on capacitor C3 relative to capacitor C2 if the two capacitors have discharged at different rates. Inductor L2*b* begins to provide power to the load ZL1 and to charge up capacitor C4. The decreased voltage across capacitors C2 and C3 causes the current through inductors L1*a* and L1*b* to ramp up and recharge capacitors C2 and C3. Sometime after the current in inductor L2*b* has returned to zero, a new cycle will begin.

The inductor L2*b* is intentionally run in discontinuous current mode so that the energy transferred to it depends entirely on only three factors: the switch SW1 on-time, the values of capacitors C1 and C2 and the value of inductors L2*a* and L2*b*, each chosen for the intended input to output voltages. This relationship permits a simple control method as opposed to the prior art which relies on more complex control chips and feedback to control SW1. In the present invention, voltage converter 40 uses only a simple timer chip.

The inductance ratio between inductors L1 and L2 has been found to be satisfactory at about 50 to 1. It has been found observed that a lower ratio doesn't properly suppress ripple through inductor L1. It has also been observed that a higher ratio reduces the power factor and introduces a significant phase shift within the circuit 40.

With reference now to FIG. 5, large magnetically coupled differential inductors L3*a* and L3*b* deliver a continuous current to the converter 50. Their large impedances protect diode bridge DB2 from fluctuations in the power supply; however, the current reversal in inductor L3 will lead to greater harmonic distortion. The self-inductance of each inductor L3*a* and L3*b* acts as a differential mode input filter. Inductors L3*a* and L3*b* are polarized such that together they also act as a common mode input filter. The leakage inductance between inductors L3*a* and L3*b* acts as a differential mode filter. The capacitors C5 and C6 further filter the input current. The input stage 51 suppresses both EMI and RFI.

After passing through the input stage 51, the current flows into the tank circuit 54. The tank circuit 54 analysis starts with capacitor C7 fully charged and no current flowing through the inductor L4. Diode D2 is reversed biased. When switch SW2 closes, capacitor C7 discharges through inductor L4 and an increasing current flows through inductor L4. When switch SW2 reopens, the reduced voltage across capacitor C7 allows diode D2 to forward bias such that the current through inductor L4 flows through diode D2, supplying the load ZL2 and recharging capacitor C8. As capacitor C7 recharges and the current through inductor L4 decreases, diode D2 once again reverse biases and any further charging of capacitor C7 occurs through inductor L4. When capacitor C7 is fully recharged the current through inductor L4 returns to zero and the converter 52 is ready for another cycle.

While single inductor L4 appears less complicated than the combination of inductors L2*a* and L2*b*, it has been observed that the inductance ratio between inductors L3 and L4 must be in the order of 200 to 1 to satisfactorily reduce input ripple.

It is envisioned that impedance converter 33 would be well suited as an input stage for a wide variety of loads including computer equipment and battery chargers.

The operation of inverter stage 34 will be described using three examples, inverter 60, inverter 70 and inverter 80.

With reference initially to FIG. 6, the operation of DC to AC inverter stage 60 is described. The power input to nodes V5+ and V5− is filtered at capacitor C9 before reaching the bridge sub-stage 62. The bridge 62 functions as is known in the art. The bridge output at winding T1*a* is magnetically coupled through leakage transformer T1 to winding T1*b* and delivered to the output stage 64 through DC blocking capacitor C13.

The bridge transistors Q1 and Q2 are lightly biased for regenerative oscillation by resistors R1 and R2. As bridge transistor Q1 turns on, the current through winding T1*a* increases and a portion is fed back through winding T1*b* to supply extra base drive to transistor Q1 to further aid turn-on. The bridge current through winding T1*a* is supplied to the tank circuit comprised of the parallel combination of capacitors C10 and C11 in series with capacitor C13 (as reflected through transformer T1) and the leakage inductance of transformer T1. The oscillations in the tank circuit switch the transistors Q1 and Q2.

Leakage transformer T1 not only drives the transistors Q1 and Q2 but also acts as an output transformer. This double duty not only reduces the number of components but also improves the low frequency operation of the circuit 60 because transformer T1, as an output transformer, has a larger core than would a transistor drive signal transformer used in the prior art. The output of the bridge is coupled from primary winding T1*a* to secondary windings T1*b*, T1*c* and T1*d*. The energy coupled to inductor T1*b* is supplied to resonant starting capacitor C14 which applies a potential difference between the output nodes V6*a*+ and V6*a*−. The current coupled to windings T1*c* and T1*d* is supplied to each of the two output nodes V6*b*+ and V6*b*− which cause thermionic emission of electrons from the electrodes of attached discharge lamp ZL3. Blocking diodes D5 and D6 isolate capacitor C14 when the discharge lamp burns out or is removed from the circuit.

Once the lamp arc has been ignited, the behaviour of the bridge sub-stage 62 changes. In the course of the tank circuit oscillations, diodes D3 and D4 alternately conduct such that capacitor C12 becomes part of the tank circuit and hence shifts the resonant frequency. The inverter 60 voltage regulation is mainly dependant upon the value of capacitor C12. For small values of capacitor C12, power will vary exponentially with input voltage. For large values of capacitor C12, power will vary linearly with input voltage.

With reference to FIG. 7, the operation of DC to AC inverter stage 70 is described. Power is supplied to nodes V7+ and V7− and filtered at the input stage 71 by capacitor C15. The transistors Q3 and Q4 are lightly biased in the linear range for regenerative oscillation to start. The bases of Q3 and Q4 are also equipped with Baker clamps D9 and D10 to avoid deep collector saturation. Inverter 70 is designed to switch slower, higher voltage transistors compared to inverter 60.

A main feature of the inverter 70 is the application of a two-step base drive to the transistors Q3 and Q4 which causes them to function more as charge amplifiers than as constant $h_{fe}$ devices. The turns ratio between winding T2*a* and windings T2*b* and T2*c* is calculated to overdrive the bases of transistors Q3 and Q4 during the first step and then to critically drive the bases during the second step.

During the initial portion of a half cycle, the total bridge current will flow through transformer winding T2*a* as capacitor C16 begins to charge. Winding T2*a* magnetically couples this current to windings T2*b* and T2*c*. The current induced in winding T2*b* overdrives the base of transistor Q3 and transistor Q3 thus turns on rapidly. However, as capacitor C16 charges, the voltage across it will grow to the point where diode D7 will begin conducting. When diode D7 begins conducting, parasitic capacitor C17 will begin charging and will divert bridge current otherwise destined for winding T2*a*. As bridge current is diverted from winding T2*a*, the base drive induced in winding T2*b* will decrease to a critical value such that transistor Q3 will begin to turn off and consume its excess collector charge. As transistor Q3 turns off, capacitor C16 will begin to discharge through winding T2*a* creating a magnetizing current in opposition to the transistor Q3 collector current. As the current reverses through winding T2*a*, a new half cycle will begin and the current induced in winding T1*c* will drive transistor Q4 into the on state.

The energy output from the bridge 72 is magnetically coupled through leakage transformer winding T3*a* to secondary windings T3*b*, T3*c* and T3*d*. Winding T3*b* applies a potential difference to resonant starting capacitor C20 across output nodes V8*b*+ and V8*b*− which induces a drift current in attached discharge lamp ZL4. Windings T3*c* and T3*d* supply a current to output nodes V8*a*+ and V8*a*− which causes thermionic emission of electrons from the attached electrodes of a discharge lamp ZL4. Blocking diodes D13 and D14 isolate capacitor C20 when the lamp ZL4 burns out or is otherwise removed from the inverter 70.

With reference now to FIG. 8, the operation of DC to AC inverter 80 is described. Power is supplied to nodes V9+ and V9−. The transistors Q5 and Q6 are lightly biased in the linear range for regenerative oscillation to start.

During the initial portion of a half cycle, the total bridge current will flow through current transformer winding T4*a* to begin charging capacitor C22. Winding T4*a* will magnetically couple this current to winding T4*b*. The current induced in winding T4*b* will be supplied to the base of transistor Q5 to provide excess base drive and promote rapid turn on. However, as capacitor C22 charges, the voltage across it will grow to the point where diode D17 will begin conducting. When diode D17 begins conducting, parasitic capacitor C23 will begin charging and will divert bridge current otherwise destined for winding T4*a*. As bridge current is diverted from winding T4*a*, the base drive induced in winding T4*b* will decrease and transistor Q5 will begin to turn off. When transistor Q5 turns off capacitor C22 will begin to discharge through winding T4*a*. As the current reverses through winding T4*a*, a new half cycle will begin and the reversed current induced in winding T4*b* will drive transistor Q6 into the on-state.

The energy output from the bridge 82 is magnetically coupled through leakage transformer winding T5*a* to secondary windings T5*b*, T5*c* and T5*d*. Winding T5*b* applies a potential difference to resonant starting capacitors C26 and C27 across output nodes V10+ and V10− which induce a drift current in attached discharge lamp ZL5. Windings T5*c* and T5*d* supply current to output nodes V10*b*+ and V10*b*− which cause thermionic emission of electrons from the electrodes of discharge lamp ZL5. Blocking diodes D21 and D22 isolate capacitors C26 and C27 when lamp ZL5 burns out or is otherwise removed from the inverter 70.

It is envisioned that inverter 34 would be suited to various alternative uses such as producing AC power from low voltage battery sources in cars, boats and recreational vehicles.

With reference to FIG. 9, the operation of the complete electronic ballast 90 is described. The impedance conversion first stage 91 is the impedance converter 50 described above. The inverter second stage 92 is the inverter 80 described above and both stages work as previously described. The description below details the effect of the control stage 93 on the conversion stage 91 and the inversion stage 92.

The control stage 93 provides both periodic and limiting control. The timer sub-stage 120 provides a periodic gate signal to mosfet switch Q7 which controls the converter stage 91. The timer sub-stage 120 is just an industry standard 555 (IC1) in a conventional configuration. The gate signal period and width are set to keep L6 in discontinuous current mode.

The inductor L6 is intentionally run in discontinuous current mode so that the energy transferred to it depends entirely on only three factors: the switch Q7 on-time, the value of capacitor C30 and the value of inductor L6, each chosen for the intended input to output voltages. This relationship permits a simple control method and while the prior art relies on complex control chips and feedback to control Q7, voltage converter 91 uses a simple timer chip (IC1).

The overcurrent sub-stage 121 measures the current through mosfet switch Q7 by the effect that current passing through resistor R7 has on transistor Q10's bias. When too much current is flowing through the tank circuit 104, the voltage across resistor R7 increases to a point where transistor Q10 is driven into conduction mode. This overcurrent condition may happen during start-up or when lamp ZL6 burns out or is otherwise removed. When the overcurrent condition is detected, Q10 shorts the reset pin of IC1 to node V12− and discharges capacitor C40 through resistor R16. The shorting of the reset pin ends the present on-cycle and the discharging of capacitor C40 delays the start of the next on-cycle until the overcurrent condition is cleared.

Also part of the overcurrent detection circuitry are diodes D26 and D27 in the inverter bridge 110, which do not generally conduct. When there is an imbalance in the system, however, diode D26 or D27 conducts, causing diodes D33 and D34 in the overcurrent detection sub-stage 121 to clamp capacitor C33 and pull down the emitter of transistor Q10 such that transistor QlO turns on and the overcurrent condition is detected.

The overvoltage detection sub-stage 122 holds the emitter of transmitter Q11 in a voltage divider network between the nodes V13+ and V13−. This divider network is comprised of zener Z2, resistors R17 and R18 and capacitor C41. When the voltage between nodes V13+ and V13− exceeds the charge on capacitor C38 by more than the reverse breakdown voltage of zener Z2, zener Z2 will breakdown and capacitor C41 will charge to a value set by the voltage divider ratio of resistance R17 to impedance R18-jwXC41 as applied to the potential difference between nodes V13+ and V13− less the recovery voltage of zener Z2. If the voltage on capacitor C41 is sufficiently high compared to the bias of transistor Q11, transistor Q11 will conduct and supply more current to the bias network of transistor Q10 causing transistor Q10 to conduct. As in the overcurrent condition, transistor Q10 will short the reset pin of IC1 to the node V10− and discharge capacitor C40 through resistor R16. At the end of the overvoltage condition, transistor Q11 will discharge capacitor C41 to an equilibrium level.

It is envisioned that the control stage 93 limiting circuitry 121 and 122 could be replaced by a feedforward system which manages the open-loop circuit based upon its analysis of a model circuit.

With reference to FIG. 11, the electronic ballast 161 is mounted between the lower inside portion of the shell 160 and the lower outside portion of the reflector 155. This placement of the ballast differs from the prior art, which places the ballast 161 proximate to the lamp socket 152. The prior art places the ballast 161 within the main thermal convection stream in the region of the lamp 154 and, thus, the ballast placement of the present invention avoids unnecessary heat buildup.

While several embodiments of the invention have been disclosed, many modifications may readily occur to those skilled in the art to which the invention relates. Accordingly the embodiments should be taken as illustrative of the invention only and not as limiting its scope as construed in accordance with the accompanying claims.

What is claimed is:

1. An electronic ballast comprising:

a) means for converting a general impedance load into a resistance, said converting means comprising:
   i) means for receiving electrical energy and maintaining a continuous direct current,
   ii) means for storing electrical energy connected serially to said receiving and maintaining means, and
   iii) means for periodically discharging said energy storing means as a discontinuous direct current supplied to the load; and b) means for inverting said discontinuous direct current into an alternating current connected serially as a load to said converting means for receiving said discontinuous direct current, said inverting means comprising:
   i) means for receiving said discontinuous direct current to be inverted,
   ii) means for receiving the inverted alternating current,
   iii) means for connecting said direct current receiving means to the alternating current receiving means for the purpose of supplying the discontinuous direct current to the alternating current receiving means and for periodically reversing the polarity of the connection so as to supply the negative discontinuous direct current to the alternating current receiving means whereby an alternating current with a frequency equal to the polarity reversal frequency is supplied to the alternating current receiving means,
   iv) means for supplying the alternating current and for applying an alternating potential difference connected to the alternating current receiving means, and
   v) means responsive to the magnitude of the alternating potential difference operable to change the polarity reversal frequency; and wherein said means for storing electrical energy comprises:

a) a first capacitor having a first terminal and a second terminal, b) a first inductor having a first terminal and a second terminal wherein said first terminal of said first inductor is connected to said first terminal of said first capacitor, c) a second capacitor including a first terminal and a second terminal wherein said first terminal of said second capacitor is connected to said second terminal of said first inductor, d) a second inductor including a first terminal and a second terminal wherein
   i) said first terminal of said second inductor is connected to said second terminal of said second capacitor,
   ii) said second terminal of said second inductor is connected to said second terminal of said first inductor, and
   iii) said second inductor is magnetically connected to said first inductor differentially, and e) switch means being operable to connect a first terminal to a second terminal wherein
   i) said first terminal of said switch means is connected to said second terminal of said first inductor, and
   ii) said second terminal of said switch means is connected to said second terminal of said first capacitor.

2. An electronic ballast as in claim 1, wherein said means for receiving electrical energy and for maintaining a continuous direct current comprises:

i) a differential pair of magnetically coupled inductors, each inductor including a first terminal and a second terminal, said first terminal being operable to receive a first AC or DC signal and said second terminal being operable to supply a second AC or DC signal, and ii) a rectifier having two input terminals and two output terminals, said input terminals each being connected to the second terminal of one of the inductors and being operable to receive the second AC or DC signal and to supply a third DC signal at the output terminals.

3. An electronic ballast as in claim 1, wherein said means for receiving electrical energy and for maintaining a continuous direct current comprises:

i) a rectifier including two input terminals and two output terminals, said input terminals being operable to receive a first AC or DC signal and said output terminals being operable to supply a second DC signal; and ii) a differential pair of magnetically coupled inductors, each inductor including a first terminal and a second terminal, said first terminals each being connected to one of the output terminals of the rectifier for receiving the second DC signal and said second terminals being operable to supply a third DC signal.

4. An electronic ballast as in claim 1, wherein said means for periodically discharging said storing means is operable within a predetermined frequency and duty cycle range to discharge an amount of energy from said energy storing means and being determined by:

a) the inductance of said energy storing means, b) the capacitance of said energy storing means, and c) the duration of the discharge interval.

5. An electronic ballast as in claim 1, wherein said means for connecting the direct current receiving means to the alternating current receiving means and for periodically reversing the polarity of said connection and said means for supplying the alternating current and for applying an alternating potential difference include a shared transformer.

6. An electronic ballast as in claim 1, wherein said means for supplying the inverted alternating current and for applying an alternating potential difference further comprises i) a resonant starting capacitor, and ii) a plurality of diodes to isolate said starting capacitor in the event of an open circuit condition in said supply means.

7. An electronic ballast, comprising:

a) means for converting a general impedance load into a resistance, said converting means comprising:

i) means for receiving electrical energy and maintaining a continuous direct current, ii) means for storing electrical energy connected serially to said receiving and maintaining means, and iii) means for periodically discharging said energy storing means as a discontinuous direct current supplied to the load; and b) means for inverting said discontinuous direct current into an alternating current connected serially as a load to said converting means for receiving said discontinuous direct current, said inverting means comprising:

i) means for receiving said discontinuous direct current to be inverted, ii) means for receiving the inverted alternating current, iii) means for connecting said direct current receiving means to the alternating current receiving means for the purpose of supplying the discontinuous direct current to the alternating current receiving means and for periodically reversing the polarity of the connection so as to supply the negative discontinuous direct current to the alternating current receiving means whereby an alternating current with a frequency equal to the polarity reversal frequency is supplied to the alternating current receiving means, iv) means for supplying the alternating current and for applying an alternating potential difference connected to the alternating current receiving means, and v) means responsive to the magnitude of the alternating potential difference operable to change the polarity reversal frequency, wherein said means for connecting the direct current receiving means to the alternating current receiving means and for periodically reversing the polarity of the connection further includes two transistors, and wherein said means for connecting the direct current receiving means to the alternating current receiving means and for periodically reversing the polarity of the connection further comprises means for applying a multiple stage base drive to said transistors.

8. An electrical circuit for converting a general impedance load into a resistance comprising:

a) means for receiving electrical energy and for maintaining a continuous direct current, b) means for storing electrical energy connected serially to said receiving and maintaining means whereby said electrical energy received is stored as a continuous direct current, and c) means for periodically discharging said storing means as a discontinuous direct current supplied to the load; and wherein said means for storing electrical energy comprises:

a) a first capacitor including a first terminal and a second terminal, b) a first inductor including a first terminal and a second terminal wherein the first terminal of said first inductor is connected to the first terminal of said first capacitor, c) a second capacitor including a first terminal and a second terminal wherein the first terminal of said second capacitor is connected to the second terminal of said first inductor, d) a second inductor including a first terminal and a second terminal wherein i) the first terminal of said second inductor is connected to the second terminal of said second capacitor, ii) the second terminal of said second inductor is connected to the second terminal of said first inductor, and iii) said second inductor is magnetically connected to said first inductor differentially, and;

e) switch means being operable to connect a first terminal to a second terminal wherein i) said first terminal of said switch means is connected to said second terminal of said first inductor, and ii) said second terminal of said switch means is connected to said second terminal of said first capacitor.

9. A circuit as in claim 8 wherein said means for receiving electrical energy and for maintaining a continuous direct current comprises:

i) a differential pair of magnetically coupled inductors, each of said inductors including a first terminal and a second terminal and being operable to receive at said first terminals a first AC or DC signal and to supply at the second terminals a second AC or DC signal, and ii) a rectifier, including two input terminals and two output terminals, the input terminals each connected to the second terminal of one of the inductors and being operable to receive the second AC or DC signal and to supply a third DC signal at the output terminals.

10. A circuit as in claim 8, wherein said means for receiving electrical energy and for maintaining a continuous direct current comprises:

i) a rectifier including two input terminals and two output terminals and being operable to receive at the input terminals a first AC or DC signal and to supply at the output terminals a second DC signal, and ii) a differential pair of magnetically coupled inductors, each of said inductors including a first terminal and a second terminal, said first terminals each being connected to one of the output terminals of the rectifier for receiving the second DC signal and the second terminals being operable to supply a third DC signal.

11. A circuit as in claim 8, wherein said means for periodically discharging said storing means is operable within a predetermined frequency and duty cycle range to discharge an amount of energy from said energy storing means, dependant upon:

a) the inductance of said energy storing means;

b) the capacitance of said energy storing means; and c) the duration of the discharge interval.

12. An electrical circuit for inverting a direct current into an alternating current comprising:

i) means for receiving the direct current to be inverted, ii) means for receiving the inverted alternating current, iii) means for connecting the direct current receiving means to the alternating current receiving means for the purpose of supplying the direct current to the alternating current receiving means and for periodically reversing the polarity of the connection for the purpose of supplying the negative direct current to the alternating current receiving means whereby an alternating current with a frequency equal to the polarity reversal frequency is supplied to the alternating current receiving means;

iv) means for supplying the alternating current and for applying an alternating potential difference connected to the alternating current receiving means; and v) means responsive to the magnitude of the alternating potential difference applied operable to change the polarity reversal frequency, wherein said means for connecting the direct current receiving means to the alternating current receiving means and for periodically reversing the polarity of the connection further includes two transistors and wherein said means for connecting the direct current receiving means to the alternating current receiving means and for periodically reversing the polarity of the connection further comprises means for applying a multiple stage base drive to said transistors.

13. A circuit as in claim 12, wherein said means for supplying the inverted alternating current and for applying an alternating potential difference further comprises i) a resonant starting capacitor, and ii) a plurality of diodes to isolate said starting capacitor in the event of an open circuit condition in said supply means.

14. A lighting assembly comprising:

a) a lamp;

b) a reflector surrounding at least a portion of said lamp;

c) a shell encircling at least a portion of the periphery of said lamp and reflector;

d) a connection operable to be mounted within a receptacle of a lighting fixture; and e) a ballast mounted between the inside of said shell and the outside of said reflector.

15. A lighting assembly as in claim 14 wherein said ballast is mounted between said shell and said reflector at a position distant from said connection.

16. A lighting assembly as in claim 15 wherein said shell wholly encircles the periphery of said lamp and reflector.

* * * * *